US008196511B2

(12) United States Patent
Ismael

(10) Patent No.: US 8,196,511 B2
(45) Date of Patent: Jun. 12, 2012

(54) METHOD FOR OVERPRINTING ALREADY PRINTED PACKAGES

(75) Inventor: Yves Ismael, Nice (FR)

(73) Assignee: Overprint AG, Zug (CH)

( * ) Notice: Subject to any disclaimer, the term of this patent is extended or adjusted under 35 U.S.C. 154(b) by 887 days.

(21) Appl. No.: 11/663,444

(22) PCT Filed: Sep. 21, 2005

(86) PCT No.: PCT/EP2005/054728
§ 371 (c)(1),
(2), (4) Date: Nov. 5, 2008

(87) PCT Pub. No.: WO2006/032679
PCT Pub. Date: Mar. 30, 2006

(65) Prior Publication Data

US 2009/0077928 A1 Mar. 26, 2009

(30) Foreign Application Priority Data

Sep. 22, 2004 (FR) ..... 04 52122

(51) Int. Cl.
*B41F 17/16* (2006.01)
*B41F 17/24* (2006.01)

(52) U.S. Cl. ..... 101/492; 101/41; 101/163

(58) Field of Classification Search ..... 101/41, 101/44, 492, 493, 163; *B41F 17/16, 17/24*
See application file for complete search history.

(56) References Cited

U.S. PATENT DOCUMENTS 3,282,202 A 11/1966 Groth et al.

FOREIGN PATENT DOCUMENTS

| | | |
|---|---|---|
| CA | 928 569 | 6/1973 |
| FR | 2 739 805 | 4/1997 |
| FR | 2 790 996 | 9/2000 |
| JP | 10286941 A * | 10/1998 |

* cited by examiner

*Primary Examiner* — Leslie J Evanisko
(74) *Attorney, Agent, or Firm* — Young & Thompson

(57) ABSTRACT

Method for overprinting already printed packages includes preparing a raster or steel magnetic block which is provided with a clamping plate, wherein the block is engraved with the aid of a jet etching device and represents new texts or patterns which are applicable by tampon printing using specific inks on a located existing and already printed part of a box, drying, verifying and packing the box. The method is used for overprinting and includes masking an undesired area by printing a blanking pavement and afterwards by overprinting a desired text, instruction or a pattern thereon and uses an automatic line including a de-stacker (3) for automatically feeding boxes, at least one printing head (1), at least one drying tunnel (4) and at least one restacker (5).

15 Claims, 6 Drawing Sheets

METHOD FOR OVERPRINTING ALREADY PRINTED PACKAGES

BACKGROUND OF THE INVENTION

The object of the invention is a process intended more specifically for overprinting of already printed packages.

The printing applies especially to corrections, additions, and/or changes on packages.

The invention makes it possible to correct a printing error. It allows a package to be re-used.

These packages to be corrected can be found especially in foodstuffs and large-scale retailing, industry, perfumery, cosmetology, and, finally, pharmacy.

The prior art can be defined by the following patents:

FR.2,739,805: This invention relates to a process designed more specifically for overprinting and consists in blanking, by pad printing, with specific inks, an already printed existing medium for purposes of overprinting a text or a design.

This process comprises the use of pad printing machines in an automated context. The media are stored in a distributor, then, according to an electronically managed rhythm, are taken by a conveyor to an automatic printer. At this stage, the media are positioned on various printing and heating stations for purposes of their overprinting. When the media have undergone all the different phases of the operation, they are discharged into a container in which they are counted.

FR.2,790,996: This process comprises the use of pad printing machines in an automated context. The media are stored in a supply cart. Then, using a manipulator arm, the media are positioned on various printing heads to be overprinted. When the media have undergone all the different phases of the operation, they are discharged onto the removal plane where they are manipulated by the operators.

WO 03 093379: The invention relates to a covering composition used as a veneer covering that contains an alkyd resin, with an average molecular mass of between roughly 500 and 2,000, and with polydispersivity of less than roughly 2. Once rebaked, this composition is essentially stable from the standpoint of color. It is essentially flexible and can be used as a veneer on a container body. The invention likewise relates to a substrate covered by said composition.

JP 2001 232980: Problem to be resolved: To provide an overprinted card of low cost and a production method in which the cost of materials is reduced and in which the production rate of the overprinted cards is improved.

Solution: In the overprinted card composed of a center part, an upper part, a magnetic card, a closing layer, a print layer, and a protective layer, it is specified that the center part 11 is a white, opaque sheet and the upper sheet 13 is a transparent sheet.

U.S. Pat. No. 6,098,541: Overprinting embosser composed of three print surface retaining portions located facing one another under non-hollow area conditions, each portion of the print surface comprising an expanded thermoplastic sheet attached to each print surface retaining portion, a portion for supporting the print surface retaining portions that can slide rotationally by means of a generally movable, resistant hinge, and a guide bar for guiding the direction of the sliding portions. Moreover, so as to control the position in which the sliding portions are stopped such that each print surface portion is positioned at a predetermined printing position, there are three grooves on the guide bar, and a spring with a projection corresponding to said grooves is fixed on the sliding portion.

These different inventions have numerous disadvantages, especially the two inventions described in patents FR.2,739,805 and FR.2,790,996. The overprinting is done by a machine that works rotationally relative to two stations. One station blanks the part to be modified; the other station applies the overprint.

This operation, by a machine with two rotary stations, does not allow production rhythms to be accelerated.

The process and the machine for implementing it can overprint 1000 (thousand) pieces per hour, according to the prior art.

SUMMARY OF THE INVENTION

According to the invention, the process and the machine make it possible to overprint four to five times more pieces per hour.

The object of the invention is an automated process designed to print existing packages, already printed or not, and solely in the form of cut-out materials.

The process consists in overprinting a text or design, which has been printed with a pad, with specific inks and different colors. These boxes of different materials can be folded and preglued when flat.

This printing process makes it possible to position a correction or print addition at a marked location using the pad printing technique.

Currently, the implementation of this process is determined by manual operations. Besides the limitation of the number of pieces produced per hour, it is difficult to quickly position the box to be treated since manipulations are currently performed by tongs or clamps that manipulate and hold the medium to be printed.

The process according to the invention makes it possible to greatly increase production rhythms and to overprint any location on the flat or glued boxes.

The process designed for printing of already printed packages consists first of all in preparing a screen or steel magnetic block with a fastening sheet; this block engraved using a spray printing device shows the new texts or designs that will be applied by pad printing, with specific inks, an existing marked and already printed part of a box; the box is then dried, checked and packaged; this process is used in overprinting, an operation that consists in covering the site no longer wanted by printing a blanking box, then overprinting the text, the slogan or the desired design, characterized by the fact that it uses an automation line comprising:

an unstacker that allows automatic feed of the boxes at least one print head at least one drying tunnel at least one restacker manipulation of said boxes is done by a suction circuit and suction cups.

Process characterized by the fact that it uses two automation lines installed in series, a first line for covering or blanking the site that is no longer wanted, a second line for overprinting the text, the slogan and/or the desired design.

According to one preferred embodiment, the print head is attached to sliding stages that allow it to move axially and lengthwise.

According to another characteristic of the invention, the print head can print directly on the unstacker.

For this purpose, the box receiving plate is relatively rigid since the force applied by the pad is 200 working-copy tons, but the lightest possible in order for the drive motor to be able to move it in the desired periods of time.

The box is pushed by a piece of sheet-metal and suctioned by the suction cups. The suction cups are placed under the receiving plate, which allows pad printing on the entire surface of the box.

The receiving plate is provided with several suction cups located under said plate, upstream; the suction cups are rectangular and downstream; the suction cups have a square shape. There are two rectangular suction cups upstream and a dozen square suction cups downstream, the suction cups taking in the air on the receiving plate to properly hold the box before and after printing by the print head, then, immediately after printing, the suction is reversed, the air is discharged by the suction cups, which makes it possible to disengage the box from the receiving plate in order for the latter to drop onto the feed plate of the heating tunnel.

BRIEF DESCRIPTION OF THE DRAWINGS

The attached drawings are given by way of example and do not limit the invention. They show only one embodiment of the invention and will allow it to be easily understood.

They show especially the movement of the sliding plate.

Figure 11:
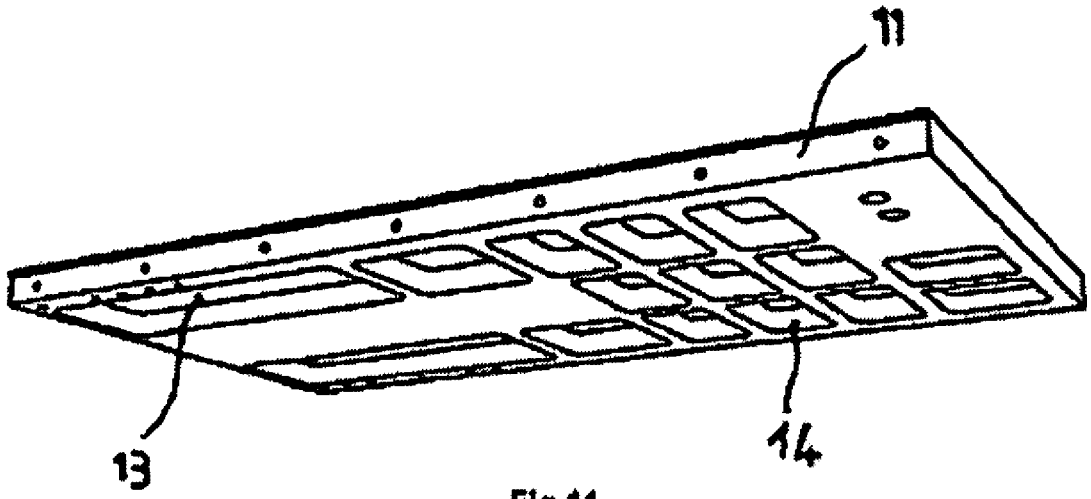

FIG. 11 is a perspective bottom view of the receiving plates of the boxes to be overprinted.

DETAILED DESCRIPTION OF THE PREFERRED EMBODIMENTS

This invention is innovative by its unstacker system that makes it possible not only to select the boxes one by one in a precise, marked and very rapid manner by virtue of its type of driving, but to allow printing of the box directly on its selection system; the purpose here is to avoid all types of manipulation between the feed unit and the printing zone and to print any location on the box.

With reference to the drawings, the invention includes the following:

the print head 1
the feed mat 2
the unstacker 3
the heating tunnel 4
the restacker 5.

The print head 1 is fixed on the sliding stages 6 that allow it to move axially and longitudinally.

The operator places the boxes on the feed conveyor 2. The boxes are routed to the cage where the guides 8, 9 will have been pre-set to the box format. The plate 11 moves back and forth between the cage and the print head by means of a brushless linear motor 10. In one direction, the box is pushed by the steel sheet with the thickness of the box that will be suctioned by the suction cups 13 during this time. Once the plate is positioned under the print head, pad printing will be done. Once the box is printed, the plate moves back. With the cessation of the suction and the return speed of the plate, the box drops by gravity on the conveyor of the heating tunnel 4. This tunnel is equipped with several drying technologies: one is pulsed hot air and the other is ultraviolet, thus allowing application of several types of ink to the boxes. Once the box is dried, it will be routed to the restacker 5. The restacker allows the boxes to be piled so that the operation can easily box them.

The process is innovative because the print head can directly print on the unstacking system. To do this, it was necessary to devise a relatively rigid plate 11 because the force applied by the pad is 2000 N, but the lightest possible so that the drive motor 10 can move it within the desired periods of time. The box is pushed by a piece of sheet-metal and suctioned by the suction cups 13, 14 (shown in FIG. 11).

The drive motors of the brushless numerical axis type currently allow movements of heavy loads with high speed and high precision. The plate 11 handles fourteen kilograms in our case and moves 35 cm in 0.3 second. The fast return of the plate 11 and cessation of suction are sufficient for the box not to return with the plate to the unstacker 3, and it drops by gravity onto the conveyor 16 of the drying tunnel 4. The complete cycle takes 0.9 second (faster than the print head: 1 s). The blots are made during other operations, which allows a printing rate of 3600 impressions/hour. Since the boxes 15 are suctioned by the bottom, pad printing 1 (print head) can be done on the entire surface of the box.

The operator places the boxes 15 on the feed conveyor 2. The boxes 15 are routed by a rolling mat on the cage on which the guides 8, 9, which have been set to the box format, feed the sliding plate 11. This sliding plate moves back and forth according to arrows F1 and F2 between the cage 12 and the print head 1 by means of a linear motor 10.

Figure 3:
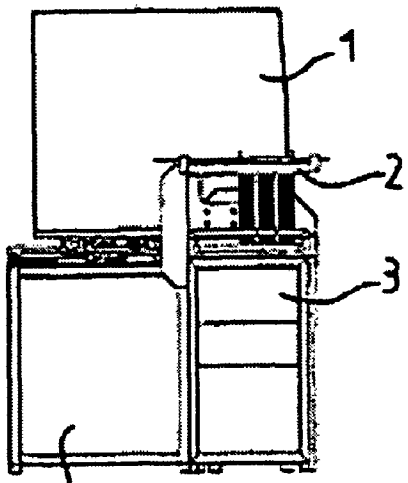
FIG. 3 is a schematic view of a production line seen from the back of the side of the feed mat.
Figure 1:
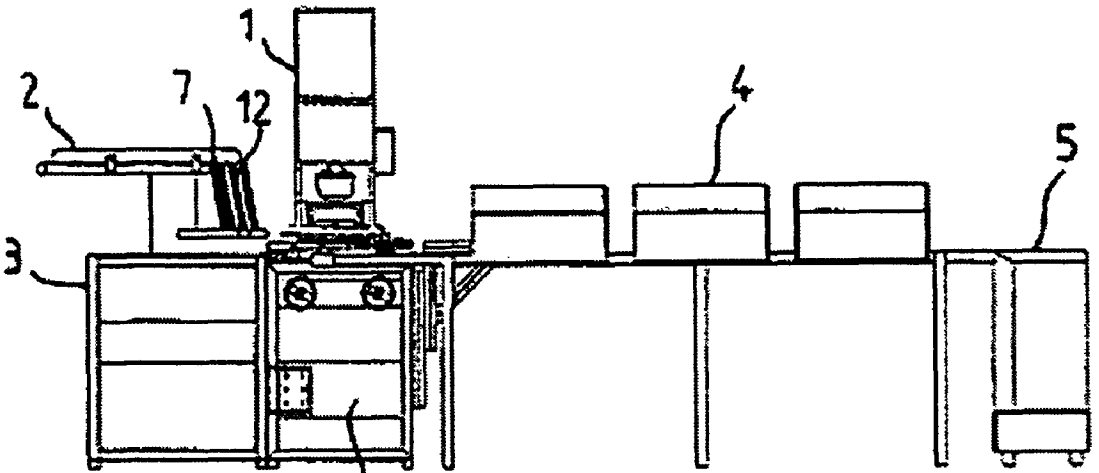
FIG. 1 is a schematic view of a production line seen from the side.
Figure 2:
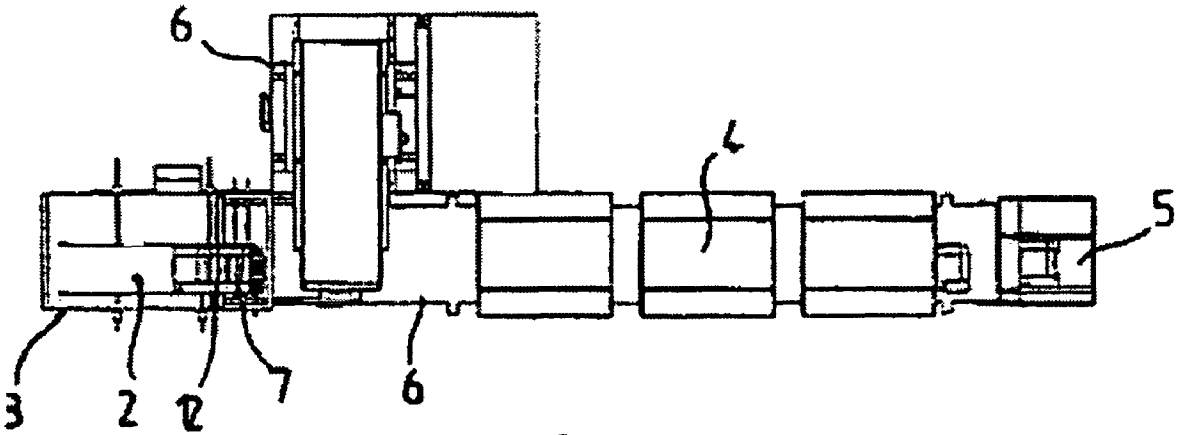
FIG. 2 is a schematic view of a production line seen from overhead.
Figure 4:
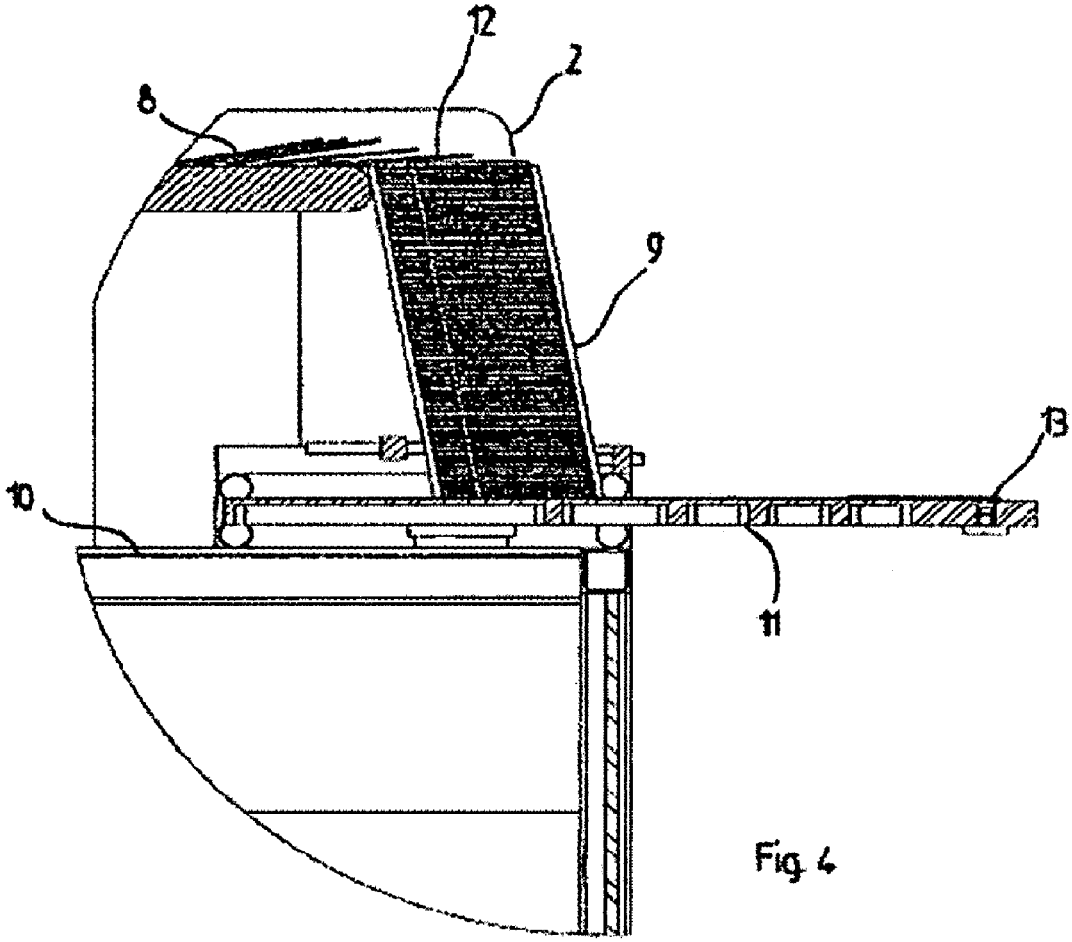
FIG. 4 is a detailed cutaway view of the unstacker.
Figure 5:
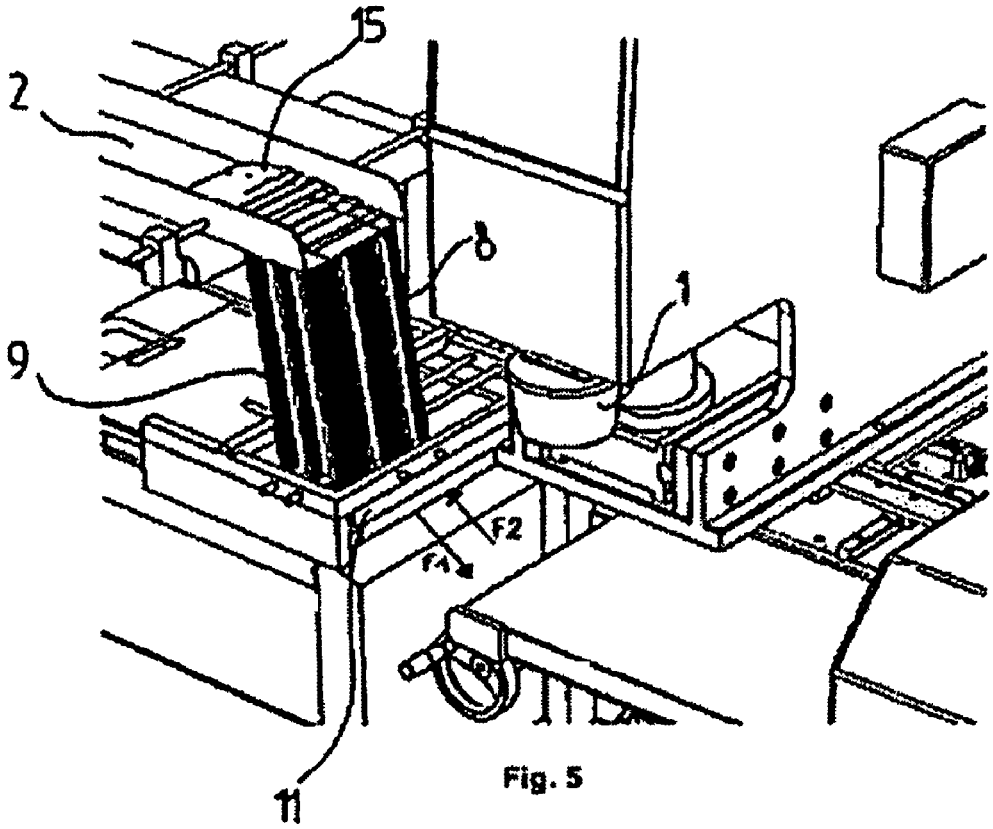
FIGS. 5 to 10 show the overprinting process.
Figure 6:
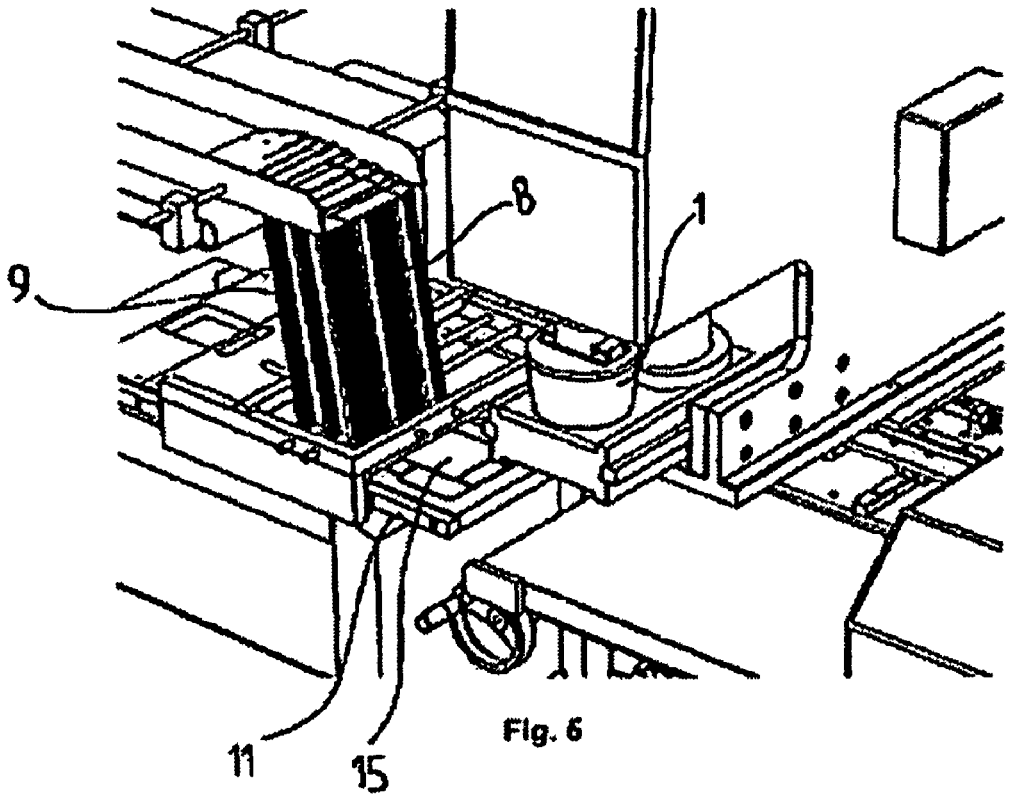
Figure 7:
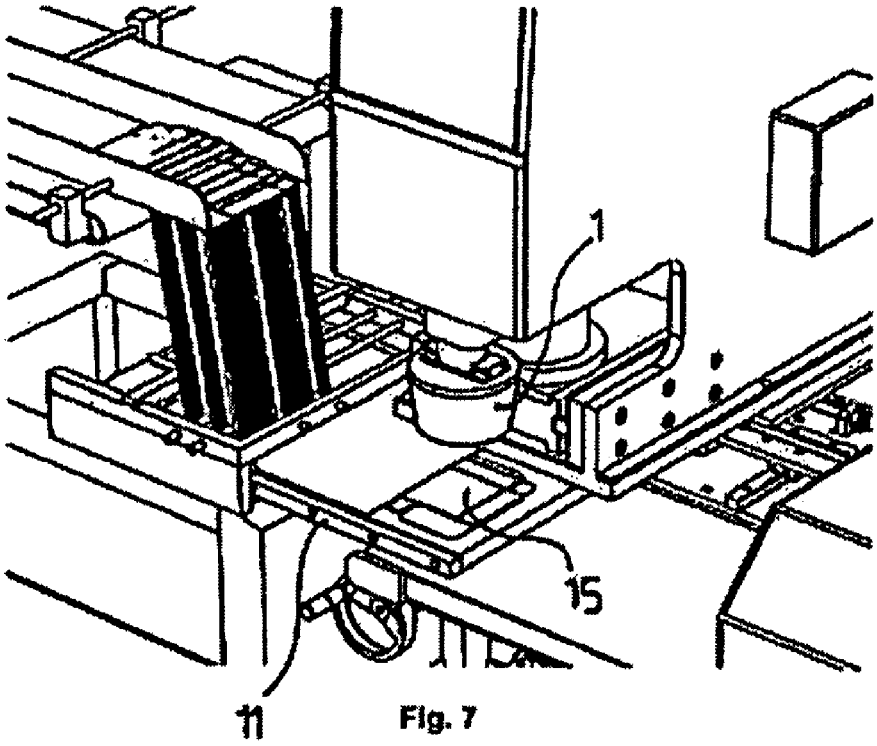

According to arrow F1 shown in FIGS. 5 and 6, the plate 11 will position the box to be printed 15 under the print head 1. Once the plate 11 is properly positioned under the print head 1, printing is done with the pad by vertical displacement of the print head 1.

Figure 8:
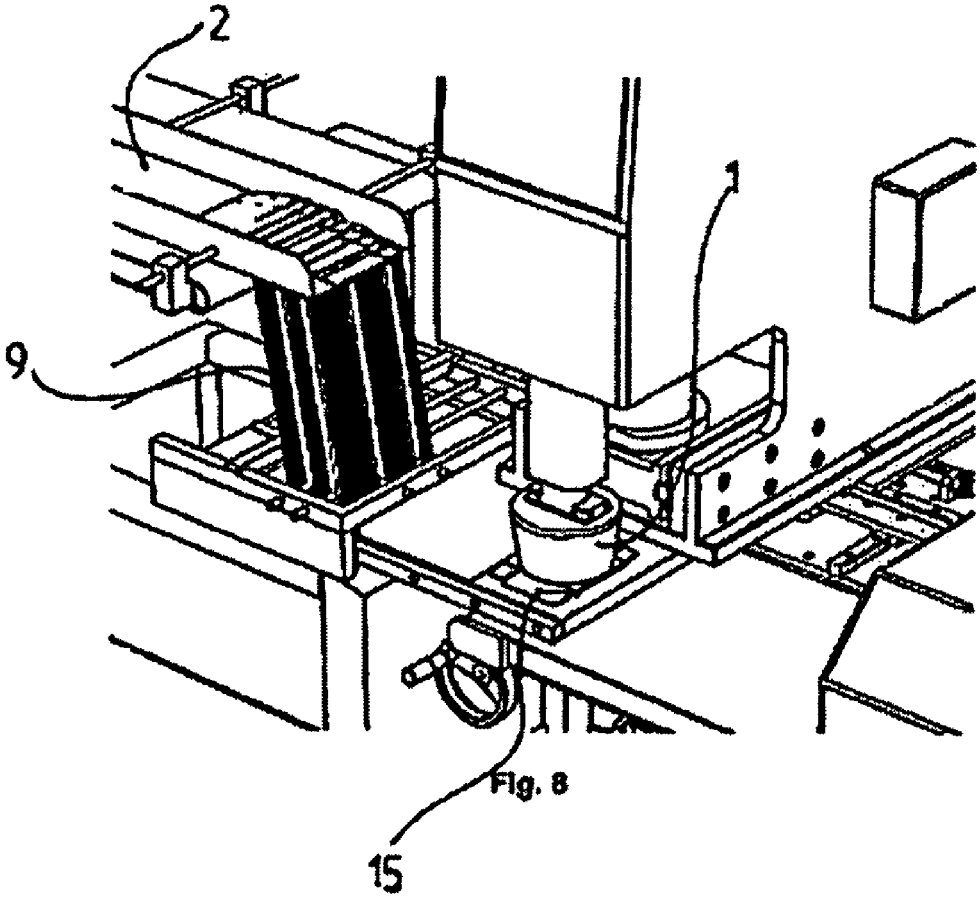
Figure 9:
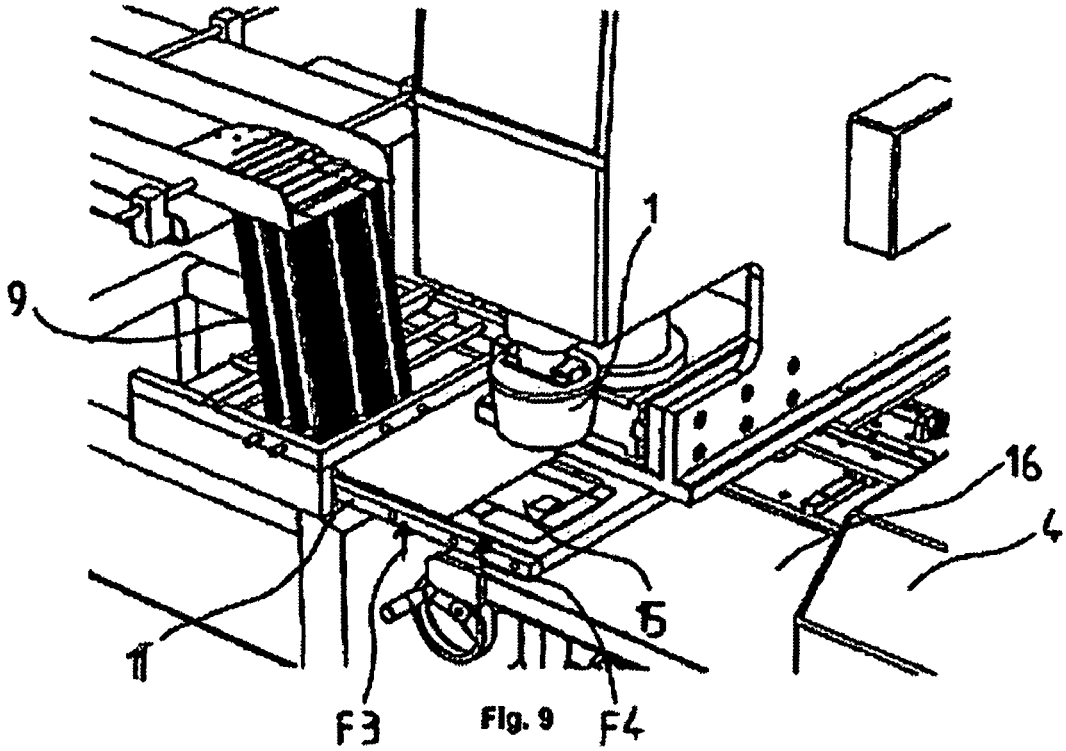
Figure 10:
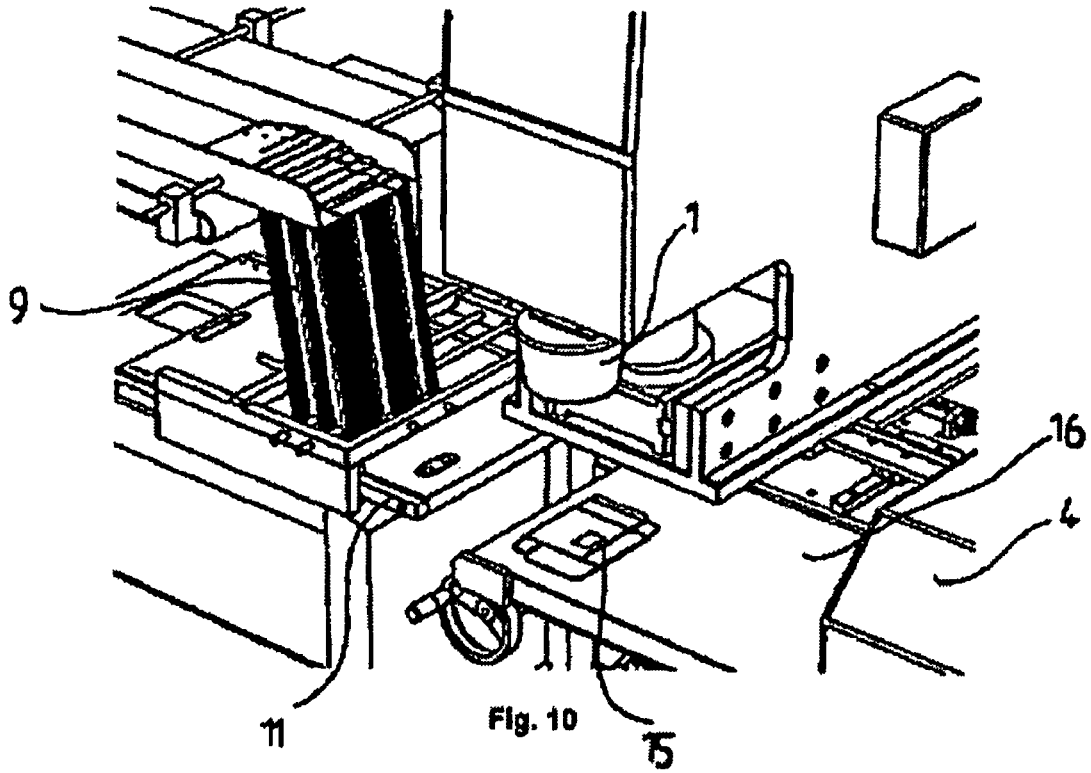

Once the box 15 has been printed, the plate 11 moves back, according to the arrow F2, the air suctioned by the suction cups is stopped and is reversed according to arrows F3 and F4, shown in FIG. 8, such that the box 15 is lifted off the plate 11 and drops by gravity onto the conveyor 16 of the heating tunnel or drying tunnel 4. This tunnel 4 allows drying of the boxes 15 that will route the dried box 15 to the restacker 5.

REFERENCES

| | |
|---|---|
| 1. | Print head or pad |
| 2. | Feed conveyor |
| 3. | Unstacker |
| 4. | Drying tunnel |
| 5. | Restacker |
| 6. | Sliding stages |
| 7. | Unstacker |
| 8. | Guides |
| 9. | Guides |
| 10. | Motor |
| 11. | Plate |
| 12. | Cage |
| 13., 14. | Suction cups |
| 15. | Boxes |
| 16. | Conveyor |

The invention claimed is:

1. A process for overprinting of already printed packages, comprising the steps of:

overprinting a new printing onto a site to be overprinted on a box by driving a print head against a surface of the box;

drying, checking, and packaging the box, wherein an automation line is used, comprising:

an unstacker (3) configured to automatically feed a plurality of boxes;

at least one print head (1);

at least one drying tunnel (4); and at least one re-stacker (5), wherein the unstacker comprises a cage (12) and a plate (11), wherein the plate (11) moves back and forth between the cage (12) and the print head (1), and wherein the print head (1) overprints the box directly on the plate of the unstacker.

2. The process according to claim 1, wherein manipulation of a box to be overprinted from said plurality boxes at the unstacker is done by a suction circuit and suction cups provided on the plate.

3. The process according to claim 2, wherein the print head (1) is attached to sliding stages enabling axial and lengthwise movement of the print head.

4. The process according to claim 1, wherein the print head (1) is attached to sliding stages enabling axial and lengthwise movement of the print head.

5. The process according to claim 4, wherein the plate (11) of the box (15) is rigid, and a force applied by the print head (1) upon the box to be overprinted is 200 newtons.

6. The process according to claim 5, wherein the box (15) is pushed by a piece of sheet-metal and suctioned by suction cups (13, 14), the suction cups being placed under the plate (11) to enable printing with the print head (1) on an entire surface of the box (15).

7. The process according to claim 6, wherein upstream suction cups (13) are rectangular, and wherein downstream suction cups (14) have a square shape.

8. The process according to claim 7, wherein, once the plate (11) is properly positioned under the print head (1), overprinting is done by vertical movement of the print head (1), wherein, once the box (15) is overprinted, the plate (11) moves back to an originating position, and air suctioned by the suction cups is stopped and is reversed such that the box (15) is lifted off the plate (11) and drops by gravity onto a conveyor (16) of the drying tunnel (4).

9. The process according to claim 6, wherein, once the plate (11) is properly positioned under the print head (1), said overprinting is done by vertical movement of the print head (1), and wherein, once the box (15) is overprinted, the plate (11) moves back to an originating position, and air suctioned by the suction cups is stopped and reversed such that the box (15) is lifted off the plate (11) and drops by gravity onto a conveyor (16) of the drying tunnel (4).

10. A process for overprinting of already printed packages, comprising the steps of:

providing an assembly line comprised of an unstacker, a print head, a drying tunnel, and a re-stacker, the unstacker comprising a cage and a receiving plate;

moving the receiving plate forwards from an originating position at the cage to a location under the print head, the receiving plate drawing a box from a stack of boxes on the unstacker;

overprinting a new printing onto a site to be overprinted on the box by driving the print head directly against a surface of the box while the box rests atop the receiving plate;

moving the receiving plate backward to the originating position such that the overprinted box is discharged from the receiving plate, wherein the print head overprints the box directly on the receiving plate of the unstacker.

11. The process according to claim 10, wherein the print head is attached to sliding stages enabling axial and lengthwise movement of the print head.

12. The process according to claim 10, wherein the receiving plate is rigid, and a force applied by the print head upon the box to be overprinted is 200 newtons.

13. The process according to claim 10, wherein the box is pushed by a piece of sheet-metal and suctioned by suction cups, the suction cups being placed under the receiving plate to enable printing with the print head on an entire surface of the box.

14. The process according to claim 13, wherein upstream suction cups are rectangular, and wherein downstream suction cups have a square shape.

15. The process according to claim 13, wherein, once the receiving plate is properly positioned under the print head, said overprinting is done by vertical movement of the print head, and wherein, once the box is overprinted, the receiving plate moves back to the originating position, and air suctioned by the suction cups is stopped and reversed such that the box is lifted off the receiving plate and drops by gravity onto a conveyor of the drying tunnel.

* * * * *